US008091703B2

(12) United States Patent
Marchetti et al.

(10) Patent No.: US 8,091,703 B2
(45) Date of Patent: Jan. 10, 2012

(54) PACKAGE OF TOBACCO ARTICLES HAVING AN INNER PACKAGE WITH A COVER FLAP FIXED TO A HINGED LID

(75) Inventors: Roberto Marchetti, Castel Maggiore (IT); Stefano Negrini, Calderara di Reno (IT)

(73) Assignee: G.D Societa' per Azioni, Bologna (IT)

( * ) Notice: Subject to any disclaimer, the term of this patent is extended or adjusted under 35 U.S.C. 154(b) by 46 days.

(21) Appl. No.: 12/601,201

(22) PCT Filed: May 21, 2008

(86) PCT No.: PCT/IB2008/001269

§ 371 (c)(1),
(2), (4) Date: Jun. 11, 2010

(87) PCT Pub. No.: WO02/079051

PCT Pub. Date: Oct. 10, 2002

(65) Prior Publication Data

US 2010/0252462 A1 Oct. 7, 2010

(30) Foreign Application Priority Data

May 22, 2007 (IT) ..... BO2007A0365

(51) Int. Cl.
*B65D 85/10* (2006.01)

(52) U.S. Cl. ..... 206/268; 206/273; 229/125.34; 229/160.1

(58) Field of Classification Search ..... 206/242, 206/249, 250, 264, 265, 268, 271, 273; 229/87.13, 229/87.14, 125.33–125.35, 160.1
See application file for complete search history.

(56) References Cited

U.S. PATENT DOCUMENTS 6,164,444 A * 12/2000 Bray et al. ..... 206/268
6,478,149 B1 * 11/2002 Parker ..... 206/273
6,505,735 B1 * 1/2003 Parker ..... 206/268
(Continued)

FOREIGN PATENT DOCUMENTS

WO WO-02079051 A1 10/2002
(Continued)

OTHER PUBLICATIONS

International Search Report in PCT/IB20080/001269 dated Oct. 8, 2008.

*Primary Examiner* — Luan K Bui
(74) *Attorney, Agent, or Firm* — Marshall, Gerstein & Borun LLP

(57) ABSTRACT

A package of tobacco articles, having: a group of tobacco articles; a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3) which is housed inside the outer container (2), encloses the group of tobacco articles, and has a tobacco article extraction opening (4) closed by a cover flap (5); at least a portion of the cover flap (5) is connected permanently and non-removably to the lid (7), so that opening and closing the lid (7) simultaneously also opens and closes the cover flap (5).

6 Claims, 7 Drawing Sheets

U.S. PATENT DOCUMENTS

| | | | | |
|---|---|---|---|---|
| 6,736,262 | B2 * | 5/2004 | Focke et al. | 206/268 |
| 7,121,403 | B2 * | 10/2006 | Bohdan et al. | 206/273 |
| 7,455,177 | B2 * | 11/2008 | Serafini et al. | 206/268 |
| 7,533,773 | B2 * | 5/2009 | Aldridge et al. | 206/738 |
| 7,827,769 | B2 * | 11/2010 | Bertuzzi et al. | 206/271 |
| 2005/0130822 | A1 | 6/2005 | Rath | |
| 2006/0231431 | A1 | 10/2006 | Tambo | |

FOREIGN PATENT DOCUMENTS

| | | |
|---|---|---|
| WO | WO-03070601-AI | 8/2003 |

* cited by examiner

PACKAGE OF TOBACCO ARTICLES HAVING AN INNER PACKAGE WITH A COVER FLAP FIXED TO A HINGED LID

CROSS REFERENCE TO RELATED APPLICATIONS

This application is the U.S. national phase of International Application No. PCT/IB2008/001269, filed May 21, 2008, which claims the benefit of Italian Patent Application No. BO 2007A000365, filed May 22, 2007.

TECHNICAL FIELD

The present invention relates to a package of tobacco articles having an inner package with a cover flap.

In the following description, reference is made, for the sake of simplicity, to a rigid, hinged-lid packet of cigarettes, purely by way of a non-limiting example.

BACKGROUND ART

Rigid, hinged-lid packets of cigarettes are currently the most widely marketed, by being easy to produce, practical and easy to use, and by effectively protecting the cigarettes inside.

A rigid, hinged-lid packet of cigarettes comprises an inner package defined by a group of cigarettes wrapped in a sheet of foil; and a rigid outer package housing the inner package. The outer package comprises a cup-shaped container housing the group of cigarettes and having an open top end; and a cup-shaped lid hinged to the container along a hinge to rotate, with respect to the container, between an open and a closed position opening and closing the open end respectively. A U-folded collar is normally fitted inside the container, and projects partly outwards of the open end to engage a corresponding inner surface of the lid when the lid is in the closed position.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, packets of cigarettes are therefore cellophane-wrapped, i.e. wrapped in a heat-sealed overwrapping of airtight plastic material. This, however, may not always be sufficient to fully preserve the tobacco in the packet, especially if the packet is consumed some time after manufacture. Moreover, when the packet is unsealed, the overwrapping is removed, thus exposing the tobacco to the atmosphere, and, if the cigarettes are not consumed soon after the packet is unsealed, the organic characteristics of the remaining cigarettes may deteriorate visibly.

In an attempt to eliminate this drawback, rigid packets of cigarettes have been proposed (e.g. of the type described in U.S. Pat. No. 4,300,676) in which the inner package is airtight, and comprises a sheet of airtight packing material having a cigarette extraction opening closed by a reusable cover flap. In other words, the cover flap has fastening means (e.g. a strip of non-dry re-stick adhesive) by which to repeatedly secure the cover flap in a closed position closing the cigarette extraction opening.

One problem of rigid packets of cigarettes with sealed inner package is that, to withdraw a cigarette from the packet, the user must first open the lid and then lift the cover flap by gripping a grip tab on the flap. In view of the small size (only a few millimeters) of the grip tab, lifting the cover flap may prove awkward (especially for less dexterous users), so it has been proposed to increase the size of the cover flap grip tab. A larger grip tab, however, inevitably sticks out from the bottom edge of the lid, thus making it difficult to keep the lid in the closed position, tends to become entangled with external objects, thus resulting in accidental opening of the lid, and impairs the look of the packet when the lid is closed.

WO03070601A1 discloses a package of cigarettes comprising: a group of cigarettes; a cup-shaped outer container having an open top end, and a cup-shaped lid hinged to the outer container along a hinge to rotate, with respect to the outer container, between an open position and a closed position opening and closing the open top end respectively; and an inner package, which is housed inside the outer container, encloses the group of tobacco articles, and has an upper tearable portion (called "pull") that is torn during the first opening of the package and is glued to an inner surface of the lid.

DISCLOSURE OF THE INVENTION

It is an object of the present invention to provide a package of tobacco articles having an inner package with a cover flap, which package is designed to eliminate the aforementioned drawbacks, while at the same time being cheap and easy to produce.

According to the present invention, there is provided a package of tobacco articles having an inner package with a cover flap, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 2:
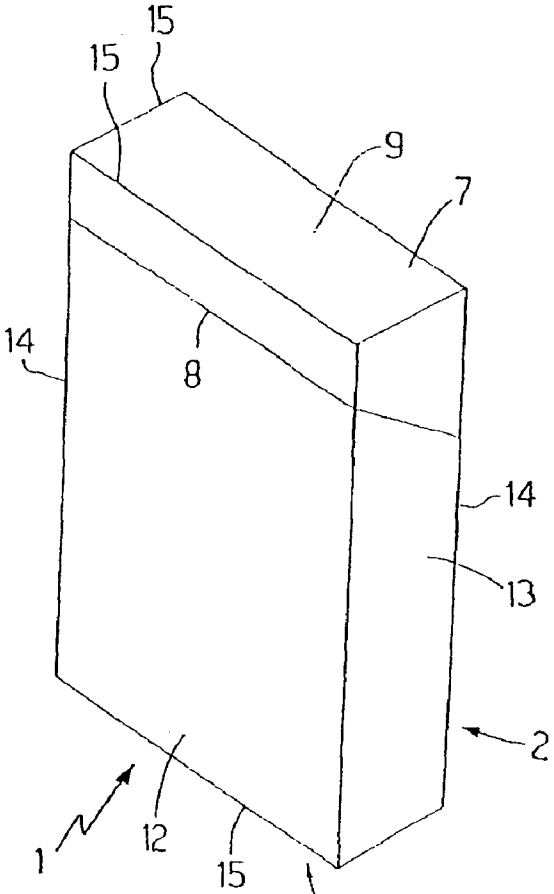
FIG. 2 shows a rear view in perspective of the FIG. 1 packet of cigarettes in a closed configuration.
Figure 1:
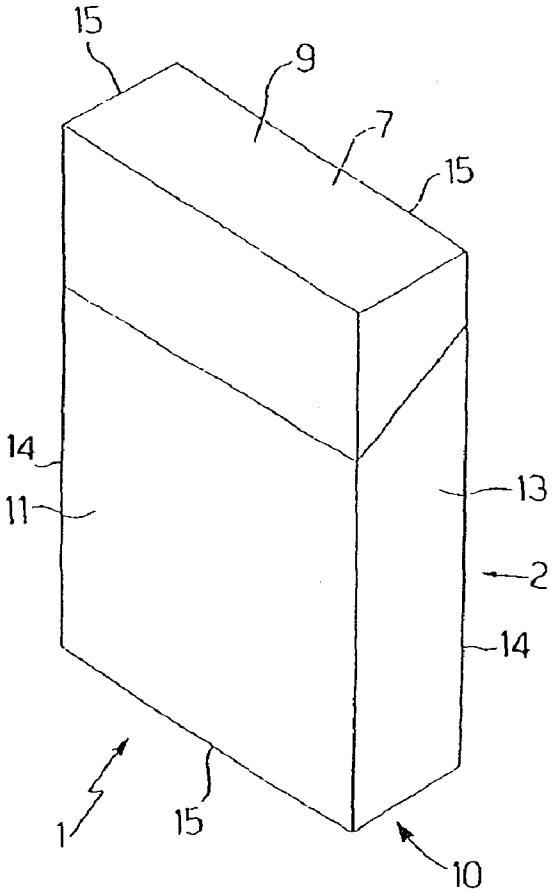
FIG. 1 shows a front view in perspective of a packet of cigarettes in accordance with the present invention and in a closed configuration.
Figure 4:
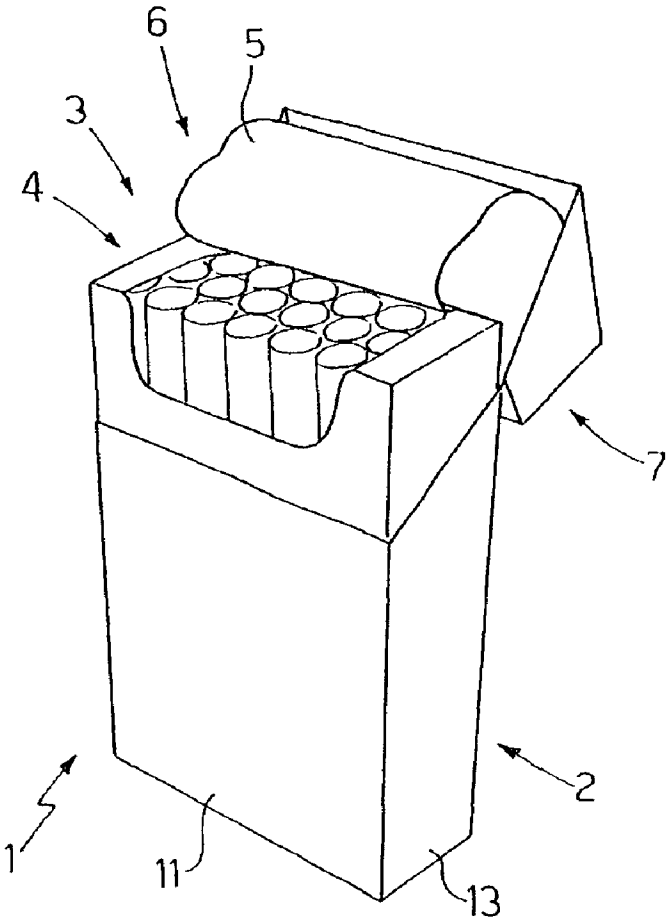
FIG. 4 shows a front view in perspective of the FIG. 1 packet of cigarettes in a fully open configuration.
Figure 3:
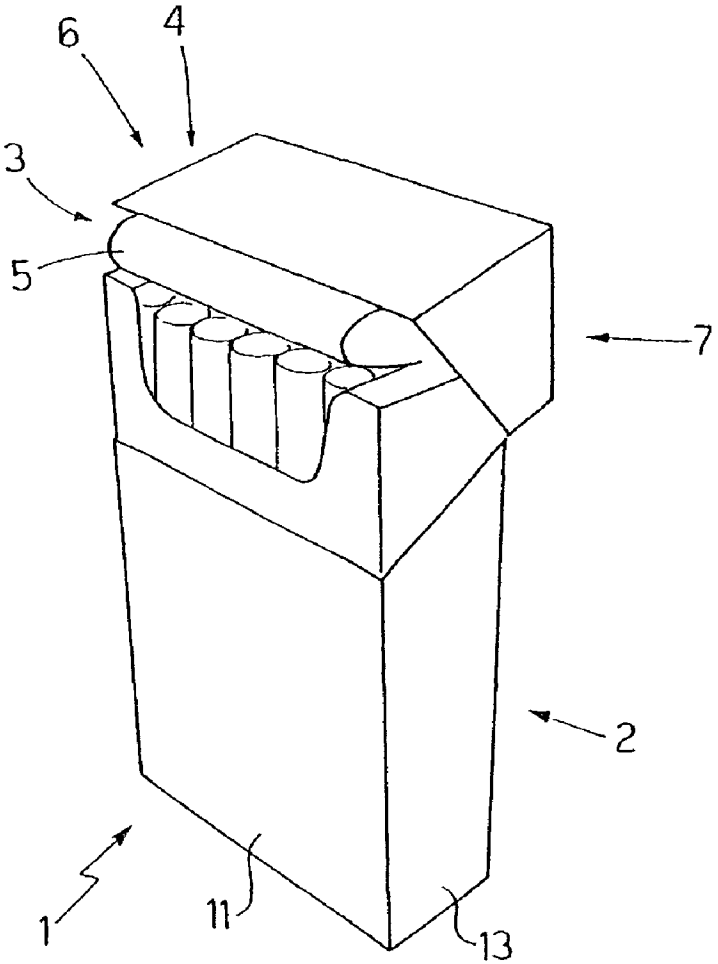
FIG. 3 shows a front view in perspective of the Figure packet of cigarettes in a partly open configuration.
Figure 5:
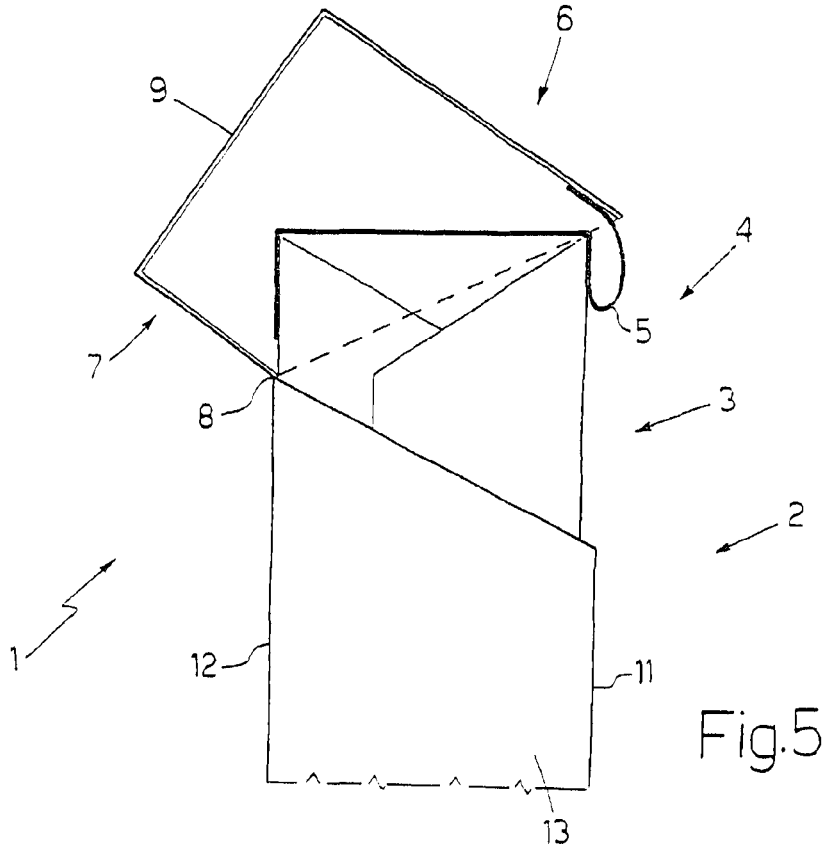
FIG. 5 shows a lateral section of a top portion of the FIG. 1 packet of cigarettes in a partly open configuration.
Figure 6:
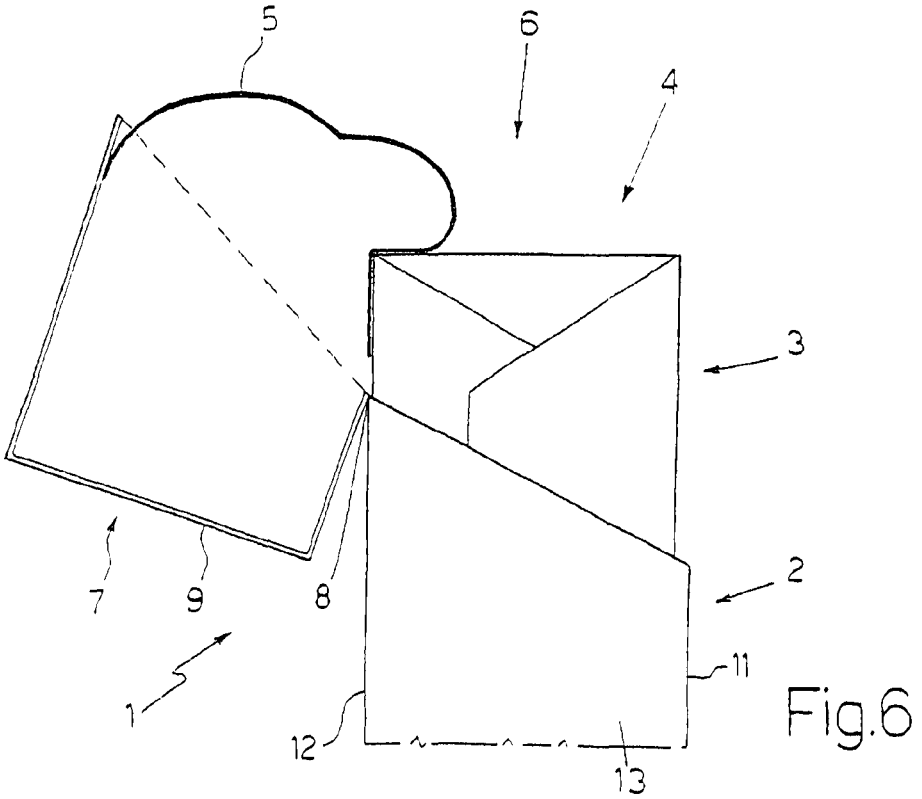
FIG. 6 shows a lateral section of a top portion of the FIG. 1 packet of cigarettes in a fully open configuration.

Number 1 in FIGS. 1-4 indicates as a whole a rigid packet of cigarettes comprising a cup-shaped outer container 2 made of rigid cardboard; and an inner package 3 housed inside container 2. Inner package 3 houses a parallelepiped-shaped group of cigarettes, and has, at the top and front, a cigarette extraction opening 4 closed by a reusable cover flap 5.

Outer container 2 has an open top end 6, and a cup-shaped lid 7 hinged to container 2 along a hinge 8 to rotate, with respect to container 2, between an open position (FIGS. 3 and 4) and a closed position (FIGS. 1 and 2) opening and closing open top end 6 respectively.

When lid 7 is in the closed position, outer container 2 is in the form of a rectangular parallelepiped comprising a top wall 9 and a bottom wall opposite and parallel to each other; two opposite parallel major lateral walls 11 and 12; and two opposite parallel minor lateral walls 13. More specifically, one major lateral wall 11 defines a front wall 11 of outer container 2, and the other major lateral wall 12 defines a rear wall 12 of outer container 2. Four longitudinal edges 14 are defined between minor lateral walls 13 and front and rear walls 11, 12; and eight transverse edges 15 are defined between top and bottom walls 9, 10 and front, rear, and minor lateral walls 11, 12, 13.

In the embodiment shown in the attached drawings, packet 1 of cigarettes has no collar. In a different embodiment not shown, packet 1 of cigarettes comprises a collar, which is folded into a U and fixed (normally glued) inside outer container 2, so as to project partly outwards of open top end 6 and engage a corresponding inner surface of lid 7 when lid 7 is in the closed position; and the collar preferably has retaining members (e.g. two lateral projections) to hold lid 7 in the closed position.

Figure 7:
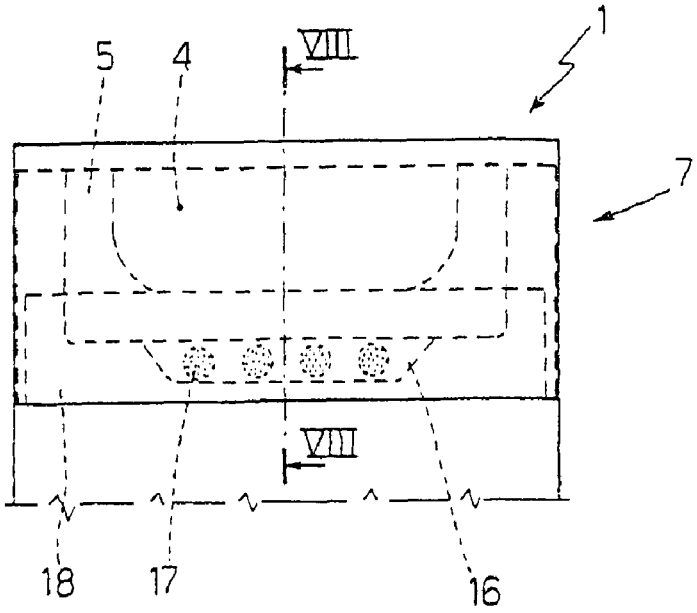
FIG. 7 shows a front view, with parts removed for clarity, of a top portion of the FIG. 1 packet of cigarettes.

Cover flap 5 is fixed to inner package 3 using non-dry, re-stick adhesive which is applied to the underside surface of cover flap 5 and extends about the whole of extraction opening 4, so cover flap 5 can be repeatedly detached partly from inner package 3 (i.e. each time packet 1 of cigarettes is opened) and then fixed back onto inner package 3. As shown in FIG. 7, cover flap 5 has a bottom tab 16 with no re-stick adhesive.

As shown in FIGS. 3-6, bottom tab 16 of cover flap 5 is connected, preferably glued, permanently and non-removably to the inner surface of lid 7, so that opening and closing lid 7 simultaneously also opens and closes cover flap 5. In a different embodiment not shown, a portion of cover flap 5 other than bottom tab may be glued permanently and non-removably to the inner surface of lid 7 in addition to or instead of bottom tab 16; in which latter case, cover flap 5 may have no bottom tab 16.

Figure 8:
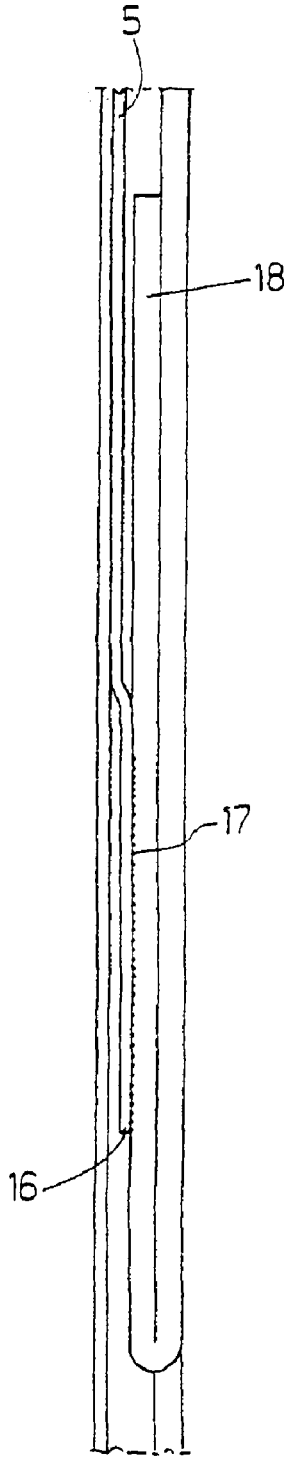
FIG. 8 shows a lateral section along line VIII-VIII of a detail in FIG. 7.

In FIGS. 7 and 8, an outer surface of bottom tab 16 of cover flap 5 is glued by spots 17 of permanent glue (i.e. non-reusable, permanently-setting glue) to a flap 18 of lid 7; in which case, bottom tab 16 of cover flap 5 remains extended and separate from the rest of cover flap 5, and, when opening lid 7, cover flap 5 forms an S-shaped fold.

Figure 9:
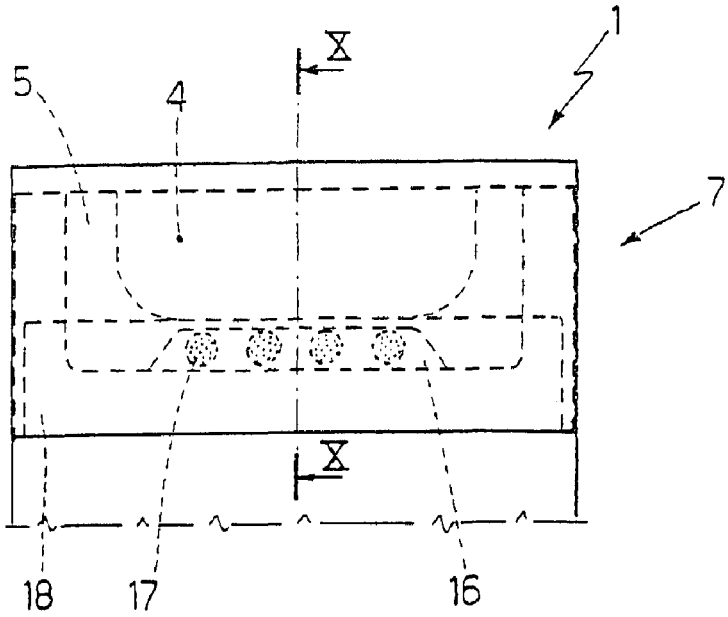
FIG. 9 shows a front view, with parts removed for clarity, of a variation of a top portion of the FIG. 1 packet of cigarettes.
Figure 10:
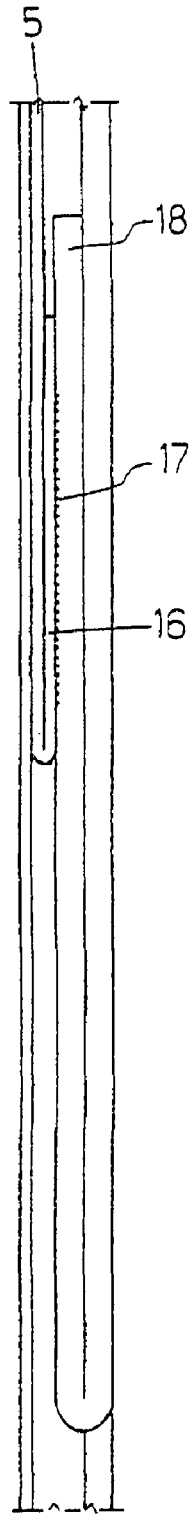
FIG. 10 shows a lateral section along line X-X of a detail in FIG. 9.

In FIGS. 9 and 10, an inner surface of bottom tab 16 of cover flap 5 is glued by spots 17 of permanent glue to flap 18 of lid 7; in which case, bottom tab 16 of cover flap 5 is folded 180° onto the rest of cover flap 5, and, when opening lid 7, cover flap 5 forms a U-shaped fold.

By making bottom tab 16 of cover flap 5 permanently integral with lid 7, cover flap 5 can be lifted simultaneously with lid 7. When opening lid 7, cover flap 5 is eased gently off inner package 3 with no stress on the cigarettes in inner package 3, and, when closing lid 7, is eased gently back onto inner package 3, accurately enclosing each part of the contour of inner package 3 in succession.

Figure 11:
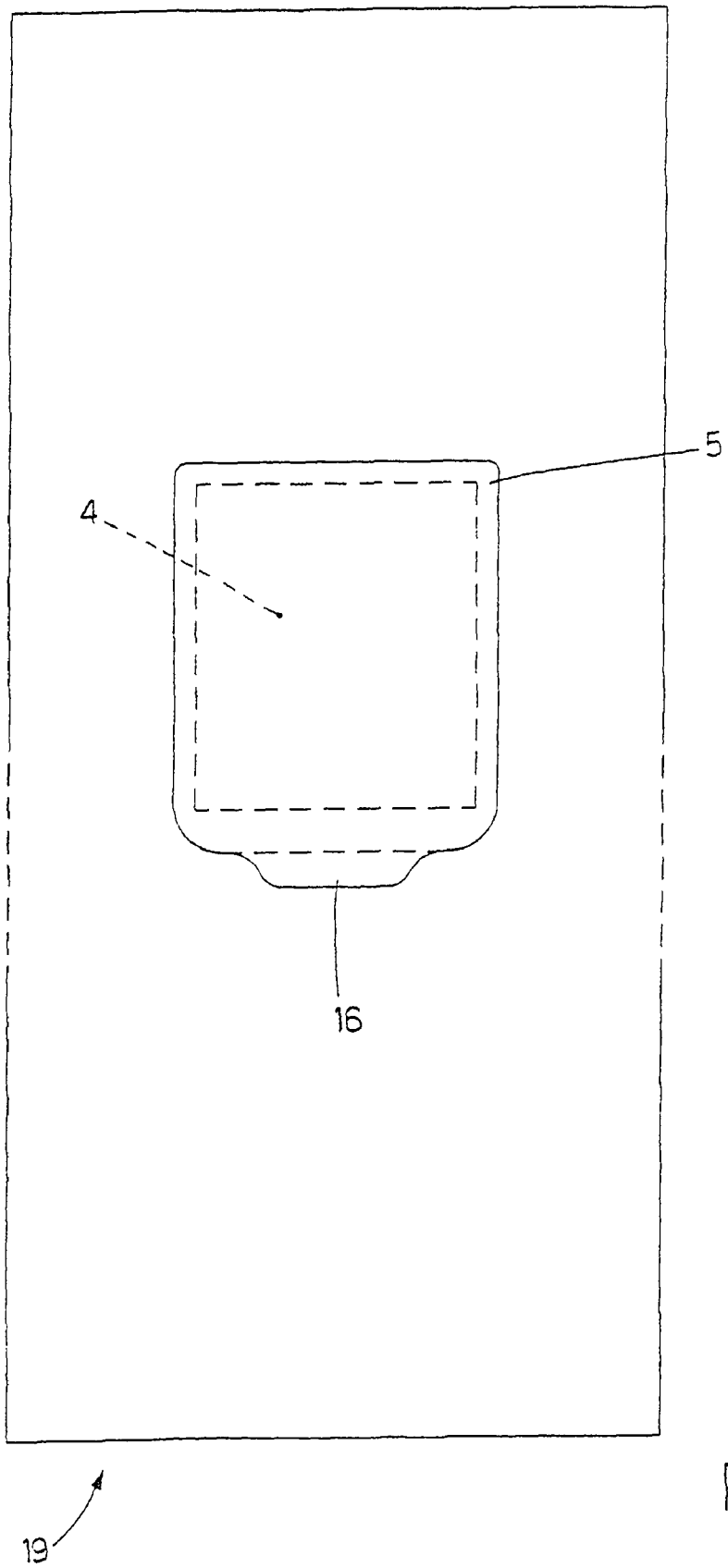
FIG. 11 shows a spread-out view of a sheet of airtight packing material from which to form an inner package of the FIG. 1 packet of cigarettes.

As shown in FIG. 11, inner package 3 is formed by folding a rectangular sheet 19 of packing material, which is first cut to define extraction opening 4, and then fitted with cover flap 5 gummed on the underside. That is, the underside surface of the cover flap is coated with re-stick adhesive which, inside extraction opening 4, glues the inner portion of sheet 19 of packing material permanently to cover flap 5, and, outside extraction opening 4, glues sheet 19 of packing material detachably to cover flap 5.

Figure 12:
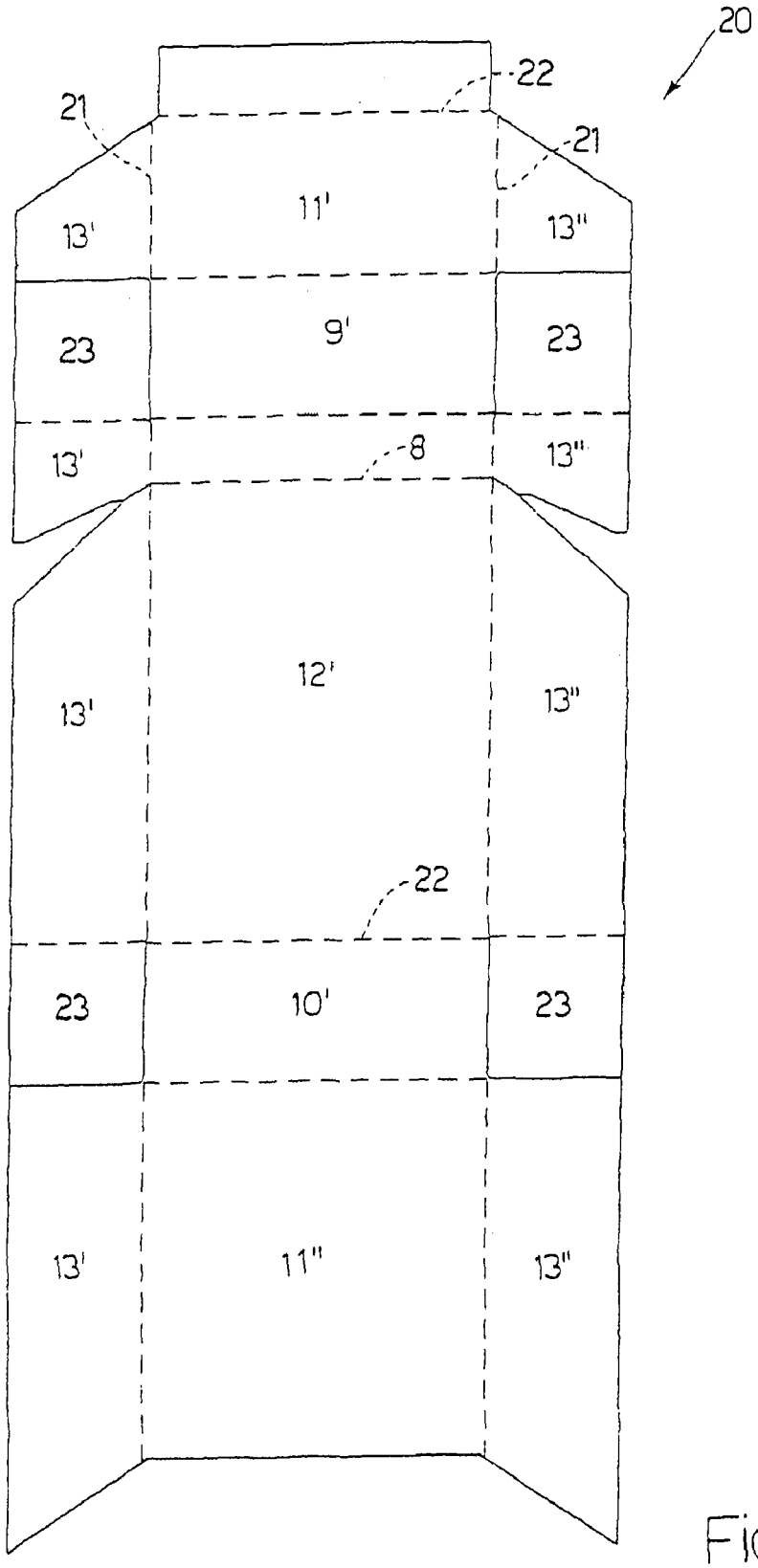
FIG. 12 shows a spread-out view of a blank from which to form an outer container of the FIG. 1 packet of cigarettes.

As shown in FIG. 12, outer container 2 is formed by folding a flat, substantially elongated rectangular blank 20 of rigid cardboard, the parts of which are indicated, where possible, in the following description using the same reference numbers, with superscripts, as for the corresponding parts of outer container 2.

Blank 20 has two longitudinal fold lines 21, and a number of transverse fold lines 22 defining, between the two longitudinal fold lines 21, a panel 11' forming a top portion of front wall 11 (more specifically, the portion forming part of lid 7); a panel 9' forming top wall 9; a panel 12' forming rear wall 12; a panel 10' forming bottom wall 10; and a panel 11" forming a bottom portion of front wall 11 (more specifically, the portion forming part of outer container 2).

Each panel 11', 11", 12' has two lateral wings 13' and 13" located on opposite sides of panel 11', 11", 12' and separated from panel 11', 11", 12' by longitudinal fold lines 21. Panel 11' has flap 18; and each lateral wing 13', 13" of panel 12' has rectangular tabs 23 located at opposite ends of lateral wing 13', 13".

When forming packet 1, lateral wings 13', 13" are superimposed and glued to define minor lateral walls 13 of outer container 2; and each tab 23 is folded squarely with respect to relative lateral wing 13', 13", and is superimposed on and glued to an inner surface of a relative panel 9', 10' to define an inner portion of a relative wall 9, 10.

In the embodiments shown in the drawings, edges 14 and 15 are all square. In a different embodiment not shown, the four longitudinal edges 14 are non-square rounded or bevelled edges.

In different embodiments not shown, at least some of longitudinal edges 14 or at least some of transverse edges 15 are rounded or bevelled (as in the packet of cigarettes described in Patent Application EP-A1-0764595). Alternatively, both some longitudinal edges 14 and some transverse edges 15 may be non-square rounded or bevelled edges.

In a different embodiment not shown, packet 1 of cigarettes may be as described in Patent Application EP1066206A1; in which case, each major lateral wall 11, is outwardly convex, is connected to each minor lateral wall 13 along a sharp longitudinal edge 14, and forms an obtuse dihedral angle with each minor lateral wall 13. Each major lateral wall 11, 12 comprises a flat central portion, and two longitudinally creased lateral bands; and each lateral band is curved with its concavity facing inwards to connect the central portion to the minor lateral wall 13 and form an obtuse dihedral angle with the minor lateral wall 13.

Clearly, changes may be made to packets 1 of cigarettes with the design described in Patent Application EP1066206A1, such as forming partly convex walls, or forming only one convex wall as opposed to two opposite convex walls, or forming convex minor lateral walls 13 as opposed to convex major lateral walls 11 and 12. By way of example, a number of variations of the packet of cigarettes described in Patent Application EP1066206A1 are proposed in Patent Application WO03026984A1.

Packet 1 of cigarettes as described above has numerous advantages, by being cheap and easy to produce, and by enabling lid 7 and cover flap 5 to be opened/closed quickly and easily, even by less dexterous users.

Moreover, packet 1 of cigarettes as described above needs no collar, by virtue of lid 7 being maintained in the closed position by the re-stick adhesive gluing cover flap 5 (and therefore lid 7 fixed to cover flap 5) to inner package 3 (and therefore to outer container 2 housing inner package 3).

In view of its numerous advantages, the design of packet 1 of cigarettes as described above may also be applied as a whole to the manufacture of a carton of cigarettes, which is substantially identical to packet 1 as described above, except that it contains packets, as opposed to a group, of cigarettes.

The invention claimed is:

1. A package of tobacco articles, comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3) which is housed inside the outer container (2), encloses the group of tobacco articles, and has a tobacco article extraction opening (4) closed by a cover flap (5);

wherein the cover flap (5) is fixed to the inner package (3) using non-dry, re-stick adhesive which is applied to the underside surface of the cover flap (5) and extends about the whole of the extraction opening (4), so the cover flap (5) can be repeatedly detached partly from the inner package (3) and then fixed back onto the inner package (3);

wherein the inner package (3) is formed by folding a sheet (19) of packing material, which is first cut to define the extraction opening (4), and then fitted with the cover flap (5) gummed on the underside with the re-stick adhesive so that the underside surface of the cover flap (5) is coated with the re-stick adhesive which, inside the extraction opening (4), glues the inner portion of the sheet (19) of packing material permanently to the cover flap (5), and, outside the extraction opening (4), glues the sheet (19) of packing material detachably to the cover flap (5);

the package (1) being characterized in that at least a portion of the cover flap (5) is connected permanently and non-removably to the lid (7), so that opening and closing the lid (7) simultaneously also opens and closes the cover flap (5).

2. A package as claimed in claim 1, wherein the cover flap (5) has a bottom tab (16) glued permanently and non-removably to an inner surface of the lid (7).

3. A package as claimed in claim 2, wherein the bottom tab (16) of the cover flap (5) is glued by spots (17) of permanent glue to a flap (18) of the lid (7).

4. A package as claimed in claim 2, wherein an outer surface of the bottom tab (16) of the cover flap (5) is glued by spots (17) of permanent glue to the inner surface of the lid (7).

5. A package as claimed in claim 2, wherein the bottom tab (16) of the cover flap (5) is folded 180° onto the rest of the cover flap (5), and an inner surface of the bottom tab (16) of the cover flap (5) is glued by spots (17) of permanent glue to the inner surface of the lid (7).

6. A package as claimed in claim 1, wherein the cover flap (5) has a bottom tab (16) with no re-stick adhesive.

* * * * *

UNITED STATES PATENT AND TRADEMARK OFFICE

CERTIFICATE OF CORRECTION

PATENT NO. : 8,091,703 B2
APPLICATION NO. : 12/601201
DATED : January 10, 2012
INVENTOR(S) : Roberto Marchetti et al.

It is certified that error appears in the above-identified patent and that said Letters Patent is hereby corrected as shown below:

ON THE TITLE PAGE:

At Item (87), PCT Pub. No., "WO02/079051" should be -- WO08/142540 --.

At Item (87), PCT Pub. Date, "Oct. 10, 2002" should be -- Nov. 27, 2008 --.

Signed and Sealed this
Twenty-ninth Day of May, 2012

David J. Kappos

David J. Kappos
*Director of the United States Patent and Trademark Office*

US008091703C1

(12) EX PARTE REEXAMINATION CERTIFICATE (10749th)

United States Patent

Marchetti et al.

(10) Number: US 8,091,703 C1

(45) Certificate Issued: Nov. 3, 2015

(54) PACKAGE OF TOBACCO ARTICLES HAVING AN INNER PACKAGE WITH A COVER FLAP FIXED TO A HINGED LID

(75) Inventors: Roberto Marchetti, Castel Maggiore (IT); Stefano Negrini, Calderara di Reno (IT)

(73) Assignee: G.D SOCIETA' PER AZIONI, Bologna (IT)

Reexamination Request:
No. 90/013,393, Nov. 7, 2014

Reexamination Certificate for:

| | |
|---|---|
| Patent No.: | **8,091,703** |
| Issued: | **Jan. 10, 2012** |
| Appl. No.: | **12/601,201** |
| PCT Filed: | **May 21, 2008** |
| PCT No.: | **PCT/IB2008/001269** |
| § 371 (c)(1), (2), (4) Date: | **Jun. 11, 2010** |
| PCT Pub. No.: | **WO2008/142540** |
| PCT Pub. Date: | **Nov. 27, 2008** |

Certificate of Correction issued May 29, 2012

(30) Foreign Application Priority Data

May 22, 2007 (IT) ..... BO2007A0365

(51) Int. Cl.

| | |
|---|---|
| ***B65D 5/60*** | (2006.01) |
| ***B65D 85/10*** | (2006.01) |
| ***B65D 75/58*** | (2006.01) |

(52) U.S. Cl.
CPC ..... *B65D 5/606* (2013.01); *B65D 75/5838* (2013.01); *B65D 85/1045* (2013.01)

(58) Field of Classification Search
None
See application file for complete search history.

(56) References Cited

To view the complete listing of prior art documents cited during the proceeding for Reexamination Control Number 90/013,393, please refer to the USPTO's public Patent Application Information Retrieval (PAIR) system under the Display References tab.

*Primary Examiner* — Sara Clarke

(57) ABSTRACT

A package of tobacco articles, having: a group of tobacco articles; a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3) which is housed inside the outer container (2), encloses the group of tobacco articles, and has a tobacco article extraction opening (4) closed by a cover flap (5); at least a portion of the cover flap (5) is connected permanently and non-removably to the lid (7), so that opening and closing the lid (7) simultaneously also opens and closes the cover flap (5).

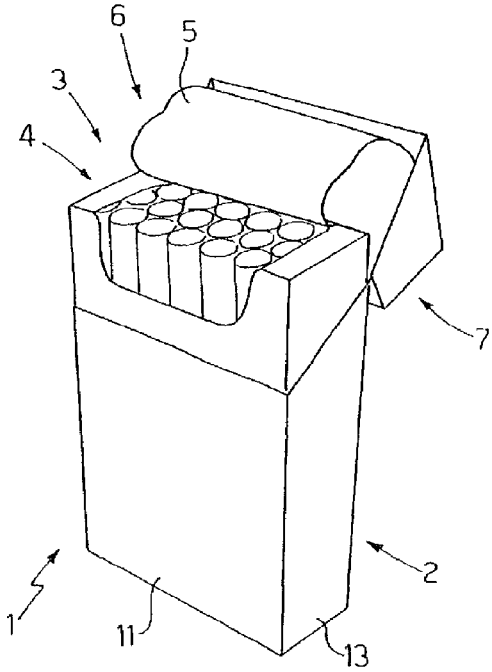

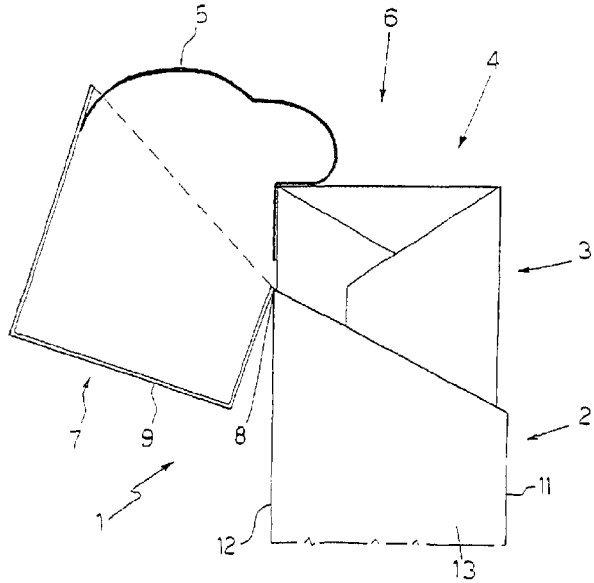

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 4-6 are cancelled.

Claims 1 and 3 are determined to be patentable as amended.

New claims 7-11 are added and determined to be patentable.

1. A package of tobacco articles, comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3) which is housed inside the outer container (2), encloses the group of tobacco articles, and has a tobacco article extraction opening (4) closed by a cover flap (5);

wherein the cover flap (5) is fixed to the inner package (3) using non-dry, re-stick adhesive which is applied to [the underside] *an inner surface* of the cover flap (5) and extends about the whole of the extraction opening (4), so the cover flap (5) can be repeatedly detached partly from the inner package (3) and then fixed back onto the inner package (3);

wherein the inner package (3) is formed by folding a sheet (19) of packing material, which is first cut to define the extraction opening (4), and then fitted with the cover flap (5) gummed on the underside with the re-stick adhesive so that the underside surface of the cover flap (5) is coated with the re-stick adhesive which, inside the extraction opening (4), glues the inner portion of the sheet (19) of packing material permanently to the cover flap (5), and, outside the extraction opening (4), glues the sheet (19) of packing material detachably to the cover flap (5);

[the package (1) being characterized in that] *wherein* at least a portion of the cover flap (5) is connected permanently and non-removably to the lid (7), so that opening and closing the lid (7) simultaneously also opens and closes the cover flap (5),

*wherein the cover flap (5) has a bottom tab (16) with no re-stick adhesive and glued permanently and non-removably to an inner surface of the lid (7); and*

*wherein the bottom tab (16) of the cover flap (5) has only one 180° folding, is folded 180° onto the rest of the cover flap (5), and the inner surface of the bottom tab (16) of the cover flap (5) is glued by spots (17) of permanent glue to the inner surface of the lid (7),*

*wherein an outer surface of the bottom tab (16) of the cover flap (5), which is opposite the inner surface of the cover flap (5), is devoid of glue to prevent any connection with the rest of the cover flap (5).*

3. A package as claimed in claim [2] *1*, wherein the bottom tab (16) of the cover flap (5) is glued by spots (17) of permanent glue to a flap (18) of the lid (7).

*7. A package of tobacco articles, comprising:*

*a group of tobacco articles;*

*a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and*

*an inner package (3) which is housed inside the outer container (2), encloses the group of tobacco articles, and has a tobacco article extraction opening (4) closed by a cover flap (5);*

*wherein the cover flap (5) is fixed to the inner package (3) using non-dry, re-stick adhesive which is applied to an inner surface of the cover flap (5) and extends about the whole of the extraction opening (4), so the cover flap (5) can be repeatedly detached partly from the inner package (3) and then fixed back onto the inner package (3);*

*wherein the inner package (3) is formed by folding a sheet (19) of packing material, which is first cut to define the extraction opening (4), and then fitted with the cover flap (5) gummed on the underside with the re-stick adhesive so that the underside surface of the cover flap (5) is coated with the re-stick adhesive which, inside the extraction opening (4), glues the inner portion of the sheet (19) of packing material permanently to the cover flap (5), and, outside the extraction opening (4), glues the sheet (19) of packing material detachably to the cover flap (5);*

*wherein at least a portion of the cover flap (5) is connected permanently and non-removably to the lid (7), so that opening and closing the lid (7) simultaneously also opens and closes the cover flap (5);*

*wherein the cover flap (5) has a bottom tab (16) with no re-stick adhesive and glued permanently and non-removably to an inner surface of the lid (7);*

*wherein the bottom tab (16) of the cover flap (5) is glued by spots (17) of permanent glue to an inner surface of the lid (7);*

*wherein the bottom tab (16) is arranged completely outside the extraction opening (4) so that the bottom tab (16) is not superimposed to the extraction opening (4) when the lid (7) is in the closed position; and*

*wherein exclusively the bottom tab (16) is connected permanently and non-removably to the lid (7) so that the spots (17) of permanent glue are completely arranged below the extraction opening (4) when the lid (7) is in the closed position.*

*8. A package as claimed in claim 7, wherein the bottom tab (16) of the cover flap (5) is glued by spots (17) of permanent glue to a flap (18) of the lid (7).*

*9. A package as claimed in claim 7, wherein the bottom tab (16) of the cover flap (5) is folded 180° onto the rest of the cover flap (5), and the inner surface of the bottom tab (16) of the cover flap (5) is glued by spots (17) of permanent glue to the inner surface of the lid (7).*

*10. A package of tobacco articles, comprising:*

*a group of tobacco articles;*

*a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and*

*an inner package (3) which is housed inside the outer container (2), encloses the group of tobacco articles, and has a tobacco article extraction opening (4) closed by a cover flap (5);*

*wherein the cover flap (5) is fixed to the inner package (3) using non-dry, re-stick adhesive which is applied to an inner surface of the cover flap (5) and extends about the whole of the extraction opening (4), so the cover flap (5) can be repeatedly detached partly from the inner package (3) and then fixed back onto the inner package (3);*

*wherein the inner package (3) is formed by folding a sheet (19) of packing material, which is first cut to define the extraction opening (4), and then fitted with the cover flap (5) gummed on the underside with the re-stick adhesive so that the underside surface of the cover flap (5) is coated with the re-stick adhesive which, inside the extraction opening (4), glues the inner portion of the sheet (19) of packing material permanently to the cover flap (5), and, outside the extraction opening (4), glues the sheet (19) of packing material detachably to the cover flap (5);*

*wherein at least a portion of the cover flap (5) is connected permanently and non-removably to the lid (7), so that opening and closing the lid (7) simultaneously also opens and closes the cover flap (5);*

*wherein the cover flap (5) has a bottom tab (16) with no re-stick adhesive and glued permanently and non-removably to an inner surface of the lid (7);*

*wherein an outer surface of the bottom tab (16) of the cover flap (5), which is opposite the inner surface of the cover flap (5), is glued by spots (17) of permanent glue to the inner surface of the lid (7); and*

*wherein, when the lid (7) is in the closed position, the cover flap (5) has a plane shape without any U-shaped or S-shaped fold and, when opening the lid (7), the cover flap (5) forms an S-shaped fold.*

*11. A package as claimed in claim 10, wherein the bottom tab (16) of the cover flap (5) is glued by spots (17) of permanent glue to a flap (18) of the lid (7).*

* * * * *